United States Patent [19]

Yamabe et al.

[11] Patent Number: 4,719,645

[45] Date of Patent: Jan. 12, 1988

[54] ROTARY ANODE ASSEMBLY FOR AN X-RAY SOURCE

[75] Inventors: Masaki Yamabe, Tokyo; Yoshitaka Kitamura, Kawasaki; Yasuo Furukawa, Zama; Toshihiko Osada, Ebina, all of Japan

[73] Assignee: Fujitsu Limited, Kawasaki, Japan

[21] Appl. No.: 895,234

[22] Filed: Aug. 11, 1986

[30] Foreign Application Priority Data

Aug. 12, 1985 [JP] Japan ..... 60-175662
Jan. 7, 1986 [JP] Japan ..... 61-000939

[51] Int. Cl.[4] ..... H01J 35/10

[52] U.S. Cl. ..... 378/144; 378/143; 378/124

[58] Field of Search ..... 378/124, 125, 143, 144, 378/121; 250/398

[56] References Cited

U.S. PATENT DOCUMENTS

| | | | |
|---|---|---|---|
| 3,683,223 | 8/1972 | Dietz | 378/144 |
| 4,336,476 | 6/1982 | Holland et al. | 378/144 |
| 4,405,876 | 9/1983 | Iversen | 378/130 |
| 4,521,903 | 6/1985 | Braun | 378/143 |
| 4,622,687 | 11/1986 | Whitaker et al. | 378/144 |

*Primary Examiner*—Janice A. Howell
*Assistant Examiner*—David P. Porta
*Attorney, Agent, or Firm*—Staas & Halsey

[57] ABSTRACT

A rotary anode assembly for an X-ray source, having a annular V-groove target portion for generating a desired characteristic X-ray emission by an electron beam bombardment applied thereto, wherein the V-grooved target portion is formed from a pair of target members each being formed into a body of rotation with respect to the axis of rotation of the assembly and having a surface including therein a coaxially-formed annular tapered portion. The target members are combined together so that the annular tapered surface portions face to each other with a predetermined angle therebetween, thereby constituting the annular V-groove. The annular V-groove target portion is formed in the peripheral surface of the rotary anode assembly or in the side surface of the anode assembly, which is perpendicular to the axis of rotation. The V-groove target portion is cooled by fluid coolant circulated through the inner space between the target member and the corresponding associated supporting member having a plurality of channels provided for allowing the fluid coolant to be supplied to the space.

15 Claims, 20 Drawing Figures

FIG. 8A
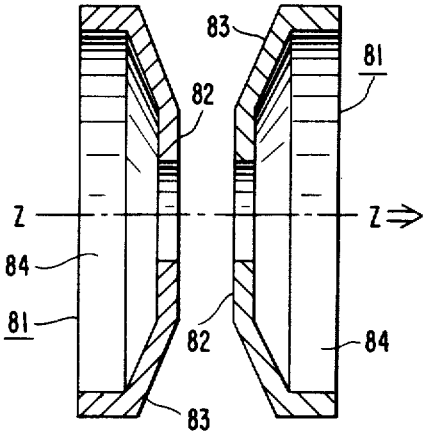
FIG. 8B
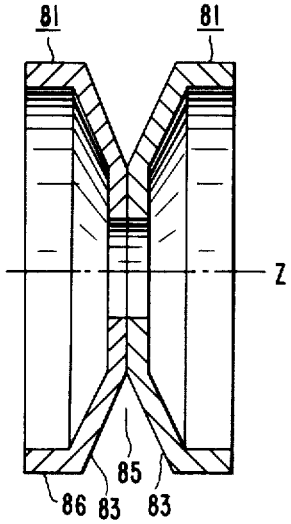
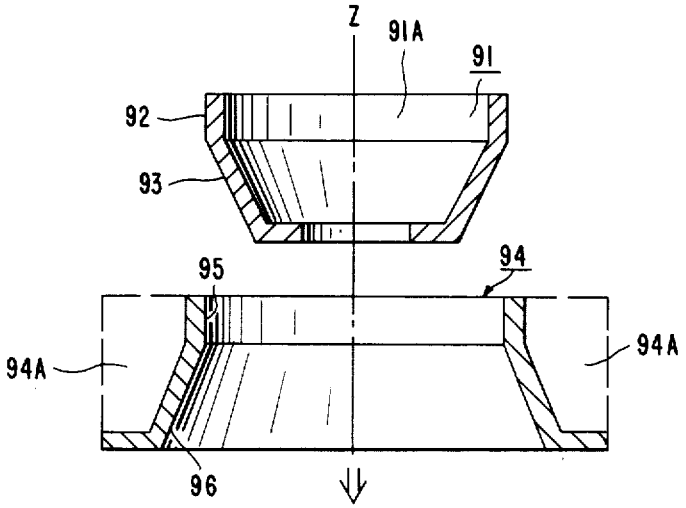
FIG. 9A
FIG. 9B
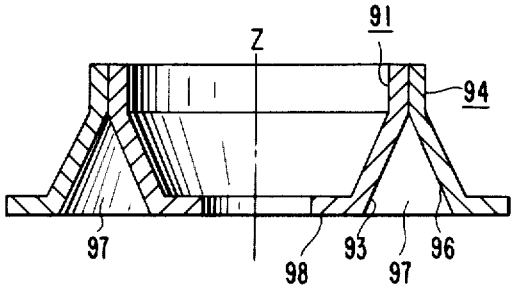

FIG. 10
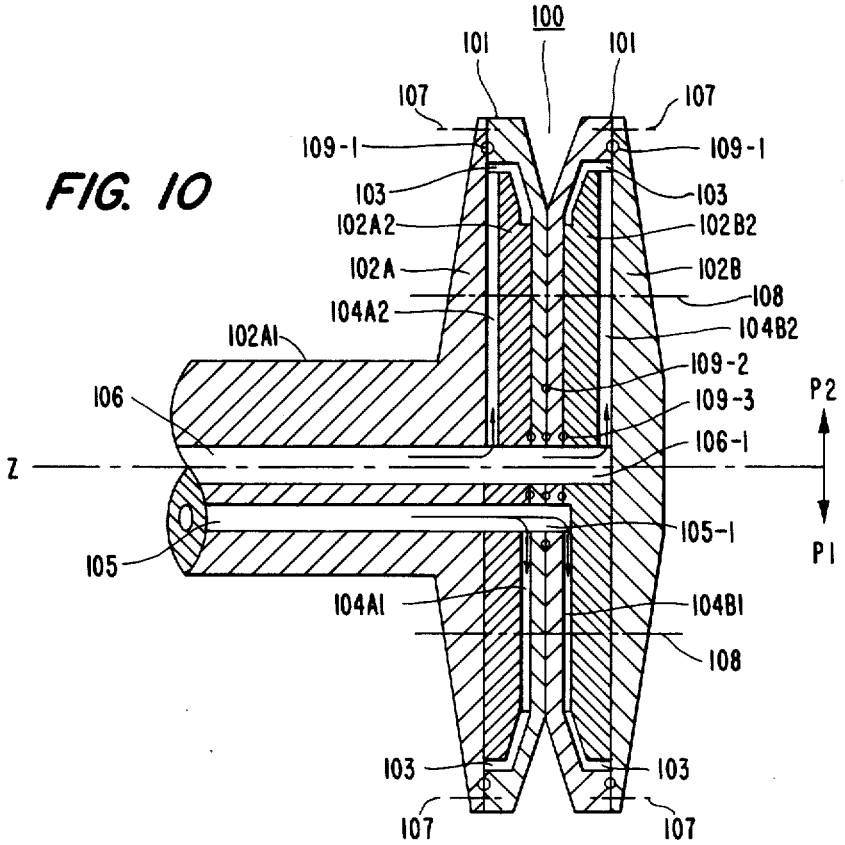
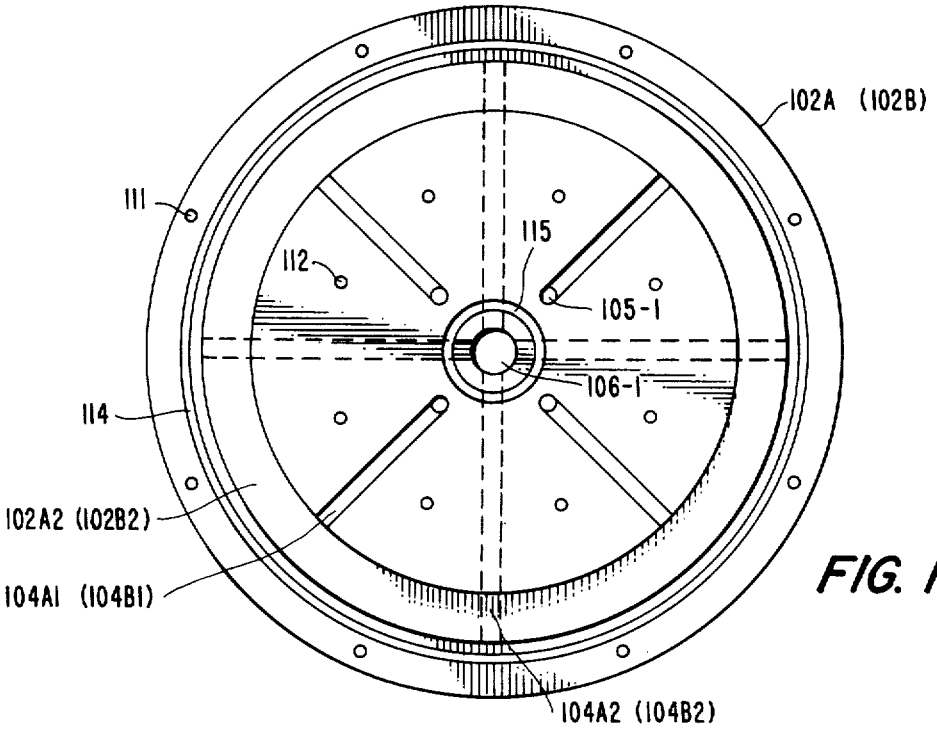
FIG. 12

ROTARY ANODE ASSEMBLY FOR AN X-RAY SOURCE

BACKGROUND OF THE INVENTION

The present invention relates to an X-ray source having a rotary anode, particularly to the structure of a member constituting a V-grooved target portion in the anode.

Among several applications of X-ray radiation, a lithography using soft X-rays having a wave length in the range from few to tens of angstroms is drawing a great attention in the semiconductor manufacturing industries. Such X-rays allow high precision transcription of fine semiconductor circuit patterns of micron or submicron on a substrate such as a silicon wafer, because of its less interference characteristic compared with the visible light used in the conventional photolithography.

An electron bombardment is usually employed for generating X-rays, wherein an anode or the target portion thereof, formed from an X-ray emissive material, is bombarded by a high energy electron beam. The X-ray sources using electron bombardment include a fixed or stationary anode type and a rotary anode type. In these types of X-ray sources, more than 99% of the energy of the incident electron beam is converted into heat and only the remainder energy is utilized to generate X-ray radiation. Therefore, to increase efficiencies in the conversion of electron beam energy into X-ray radiation and in the removal of heat dissipated at the anode or target portion is a crucial problem in the design of electron bombardment type X-ray sources.

A rotary anode X-ray source is designed to alleviate the heat dissipation problem. The apparent area of the target portion in a rotary anode is relatively increased and, therefore, the mean value of the electron beam power density on the target area can be kept low compared with that on a stationary anode. Thus, a rotary anode X-ray source can be operated under an input electron beam power as much as 100K-Watts, compared with the allowable input electron beam of about 10K-Watts in a stationary anode type source, thereby providing an X-ray emission of greater intensity.

To increase the conversion efficiency of the electron beam energy to an X-ray emission, a rotary anode having a V-grooved target portion was proposed. There are several disclosures of this type of X-ray source, including the U.S. Pat. Nos. 4,336,476 published June 22, 1982 and 4,405,876 published Sept. 20, 1983, and Japanese patent applications Tokukaisho No. 59-205139 published Nov. 20, 1984, Tokukaisho No. 59-221950 published Dec. 13, 1984 and Tokukaisho 60-254540 published Dec. 16, 1985. Referring, for example, to the Tokukaisho No. 60-254540, the inventor of which application is the co-inventor of the present invention, it is described that the X-ray conversion efficiency of a rotary anode is increased by providing therefor a V-grooved target portion, because the back-scattered electrons are almost absorbed during their multiple collisions with the surface of the V-grooved target. Further, the uniformity of the X-ray field intensity distribution can be improved by the use of a V-grooved target.

FIG. 1 shows an X-ray tube disclosed by the above U.S. Pat. No. 4,336,476, wherein an anode target disc 11 rotated by a skirt-type rotor 12 is provided with a focal track groove 13 disposed in the peripheral rim surface 14 thereof. FIG. 2 shows a part of liquid cooled anode X-ray tube disclosed by the above U.S. Pat. No. 4,405,876, wherein a V-groove 21 is provided on the periphery of a rotating anode 22. The rotating anode 22 is cooled by liquid flowing through a space between the anode 22 and a stationary septum 23. FIG. 3 shows a rotating anode X-ray tube disclosed by the above Tokukaisho No. 59-221950, wherein a target 31 rotated by a rotor 32 is provided with a V-groove 33. FIG. 4 shows a rotating anode for a high power X-ray source disclosed by the above Tokukaisho No. 59-205139, wherein a V-groove formed on the periphery of a rotating circular anode 41 is provided with a backwardly extending hollow portion 42 for eliminating the high power density of incident electron beam at the apex of the V-groove. FIG. 5 shows a rotary anode disclosed by the above Tokukaisho 60-254540, wherein a V-groove 51 provided on the periphery of a rotary anode 52 has a cross-section in which the direction of the normal line to the surface of the V-groove is not constant with respect to the direction of the incident electron beam 53 but varies from zero at the periphery of the V-groove 51 to approximately 90° at the apex of the V-groove 51. A similar variable taper V-groove 62 is provided on a flat surface of a rotary anode 61, perpendicular to the electron beam 63 incident thereon, as shown in FIG. 6.

In any one of the above disclosures, the V-groove constituting an electron beam track (target portion) is formed by engraving a cylindrical or flat side surface of a rotary anode. However, such rotary anode or target portion has disadvantages as summarized below.

(a) Low mechanical strength of a rotary anode (b) Difficulty in the machining of an anode having a V-groove formed therein.

(c) High input power density at the apex of the V-groove (d) Poor adhesion of an X-ray emissive material layer formed on the surface of the V-groove.

These disadvantages will be discussed briefly in the following.

Firstly, a rotary anode is generally formed from such a material having a high mechanical strength and thermal conductivity as copper (Cu) or copper-based alloy, Cu-Cr, for example. However, when the rotary anode having a V-groove formed therein is rotated at a speed of few to ten thousands rpm, a stress is concentrated at the apex of the V-groove. As a result, if a flaw exists there, it grows to extend into the anode member in the radial direction, and finally results in causing the breakage of the rotary anode member. In addition, it is difficult to provide a sharp apex for a V-groove when the apex is formed by engraving an anode member. The apex of a V-groove generally has a surface portion formed substantially perpendicular to the incident electron beam. Such surface portion is inevitably burdened with an excessive input power density (power per unit area). Hence, temperature at the apex is raised and a heat stress is generated. Thus, the above-mentioned breakage of the rotary anode due to the growth of flaw is accelerated.

Secondly, a layer of an X-ray emissive material, aluminum (Al), silicon (Si) or palladium (Pd), for example, is generally formed on the surface of the V-groove, in order to provide a desired characteristic X-ray emission. However, if the X-ray emissive material layer of a thickness of one micron or more is formed on the surface of the V-groove uniformly by using an ion plating technology, it is difficult to assure a high adhesion strength between the X-ray emissive material layer and the V-groove surface, because, the adhesion strength of a layer deposited on a surface by an ion plating is maximum when ions impinge perpendicularly to the surface and decreases as the incidence angle of the ions becomes smaller. In the ion plating of the V-groove surface, ions inevitably impinge on the V-groove surface obliquely, relatively deviated from the the perpendicular condition. Thus, poor adhesion is established between the V-groove surface and the X-ray emissive material layer and the layer can not remain on the surface under the high speed rotation of the anode and the application of thermal stress caused by the electron bombardment applied thereto.

Thirdly, a rotary anode for an X-ray source is sometimes furnished with a cooling means therefor, as shown in one of the above cited disclosures. For this cooling, the anode assembly inevitably has a complicated structure usually composed of a member for constituting a target portion and another member for circulating fluid coolant for the target member having a V groove. Accordingly, machining of these members involves a great deal of difficulties.

SUMMARY OF THE INVENTION

It is, therefore, an object of the present invention to provide a V-grooved rotary anode assembly for an X-ray source, the rotary anode having an improved mechanical strength to withstand the breakage thereof due to the high speed rotation thereof and the thermal stress caused by the electron beam bombardment applied thereto.

It is another object of the present invention to provide a V-grooved rotary anode assembly for an X-ray source, the V-groove having a surface provided with an X-ray emissive material layer, wherein the adhesion of the X-ray emissive material layer to the V-groove surface is enhanced.

It is still another object of the present invention to provide a V-grooved rotary anode assembly for an X-ray, wherein the anode assembly has a structure suitable for facilitating the machining of the V-groove formed therein.

The above objects can be attained by a V-grooved rotary anode assembly for an X-ray source, wherein the rotary anode assembly comprises a pair of target members each being formed in a body rotating around the axis of rotation of the rotary anode assembly and having a coaxially-formed annular tapered surface portion formed at the periphery thereof. The target members are fabricated separate each other and then coaxially combined together in a manner that the respective annular tapered surface portions face to each other with a predetermined angle therebetween so as to constitute the annular V-groove of the rotary anode assembly. In one aspect of the present invention, each of the target members is formed to have a coaxial convex surface including therein the annular tapered surface portion. The target members are disposed in a manner that the convex surfaces contact with each other, except for the respective annular tapered surface portions thereof, such that the annular V-groove is formed in the peripheral surface of the anode assembly. In another aspect of the present invention, one of the target members is an inner body having a coaxially-formed outer side surface including therein the annular tapered surface portion, and another of the target members is an annular outer body having a coaxially-formed inner side surface including therein the annular tapered surface portion. The inner and annular outer target members are disposed in a manner that the coaxially-formed outer side surface of the inner target member is fixedly engaged in the annular outer target member, such that the annular V-groove is formed in a side plane of the anode assembly, the side plane being perpendicular to the axis of rotation. In further another aspect of the present invention, each of the target members is formed so as to constitute a V-groove having an M-shaped cross-section at the periphery thereof, when they are combined together.

BRIEF DESCRIPTION OF DRAWINGS

The foregoing objects as well as other aspects and advantages of the invention will become apparent from a reading of the following description of the disclosure taken in connection with the accompanying drawings forming a part thereof, in which:

FIGS. 8A and 8B are cross-sections illustrating a pair of target members for a rotary anode in accordance with the first embodiment of the present invention;

FIGS. 9A and 9B are cross-sections illustrating another pair of target members for a rotary anode in accordance with the second embodiment of the present invention;

FIG. 10 shows cross-sections of a rotary anode assembly in accordance with the third embodiment of the present invention, taken at different phases of rotation;

FIG. 12 is a plan view of the supporting member 102A or 102B shown in FIGS. 11A or 11B;

DESCRIPTION OF PREFERRED EMBODIMENTS

Figure 7:
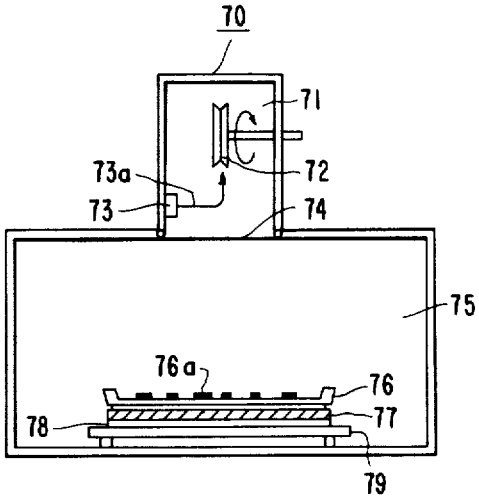
FIG. 7 PRIOR ART
FIG. 7 is a conceptual schematic for illustrating an application of a rotary anode type X-ray source.

FIG. 7 is a conceptual schematic for illustrating an application of a rotary anode type X-ray source. Referring to FIG. 7, an X-ray exposure system 70 comprises a vacuum chamber 71 evacuated to a pressure of $10^{-6}$ to $10^{-7}$ Torr by a not shown vacuum system, a rotary anode 72 rotated therein by a not shown driving means, an electron gun 73 providing an electron beam **73*a* in the vacuum in the chamber 71 and an X-ray transmissive window 74 formed from a Be foil, for example, and disposed at an end opening of the vacuum chamber 71. The electron beam 73*a* is deflected to bombard the peripheral side of the rotary anode 72, and thus, an X-ray radiation is provided. The X-ray radiation is transmitted through the Be foil window 74 into an exposure room 75 filled with a He gas of 1 atm and irradiates a mask 76 of a thin X-ray transmissive film having Au circuit patterns 76a, for example, delineated therein. Thus, the circuit 76a patterns are transcribed in a resist layer 77 applied to a substrate 78 such as a Si wafer which is disposed on a stage 79**.

According to the present invention, a rotary anode for an X-ray source comprises a pair of target members which eventually provide a V-groove target portion constituting an electron beam track generating X-rays. FIGS. 8A and 8B are cross-sections illustrating a pair of target members for a rotary anode in accordance with the first embodiment of the present invention. Referring to FIG. 8A, each target member 81 is formed as a body of rotation with respect to an axis Z. Each of the target members has a coaxially-formed convex surface 82 including therein an annular tapered surface portion 83 formed on the peripheral edge the target member 81. Usually, each of the target members 81 is provided with a hollow portion 84 formed in its side surface opposite to the convex surface 82. The hollow portion 84 is provided for accommodating therein a supporting member, as will be described later. The target members 81 are coaxially disposed with respect to the axis Z in a manner that the convex surfaces 82 contact with each other, except for the annular tapered surface portions 83, as shown in FIG. 8B. Thus, the respective annular tapered surface portions 83 of the target members 81 face each other with a predetermined angle, 30°, for example, therebetween, thereby providing an annular V-groove 85. In accordance with the first embodiment, the annular V-groove 85 is formed in the peripheral side surface 86 of the combined target members 81.

FIGS. 9A and 9B are cross-sections illustrating another pair of target members for a rotary anode in accordance with the second embodiment of the present invention. Referring to FIG. 9A, a first target member 91 is formed in a body of rotation with respect to an axis Z and has a coaxially-formed peripheral side surface 92 including therein an annular tapered surface portion 93 formed on an edge of the peripheral side surface 92. A second target member 94 is formed in an annular body with respect to the axis Z and has a coaxially-formed inner side surface 95 including therein an annular tapered surface portion 96 formed on an edge of the inner side surface 95. The first target member 91 and the annular second target member 94 are disposed in a manner that the peripheral side surface 92 of the first target member 91 is fixedly engaged in the inner side surface 95 of the annular second target member 94, as shown in FIG. 9B. Thus, the respective annular tapered surface portions of the first and second target members face each other with a predetermined angle, 30°, for example, therebetween, thereby providing an annular V-grooved 97. According to the second embodiment, the annular V-groove 97 is formed in a side plane of the combined target members 91 and 94, which side plane is perpendicular to the axis Z.

Usually, the first target member 91 is provided with a hollow portion 91A formed in a flat side surface thereof, and the second target member 94 is provided with an annular cutout portion 94A formed therearound. The hollow portion 91A and cutout portion 94A are provided for respectively accommodating therein corresponding supporting members, as will be described later.

The separated structure of the target members disclosed by the first and second embodiments provides advantages as follows: (a) The separated target members as shown in FIGS. 8A or 9A can easily be machined compared with a structure like as that equivalent to the combined target members shown in FIGS. 8B or 9B. (b) As mentioned above, the surface of the target member, at least the annular tapered surface portion thereof is often coated with a layer of a material such as Al, Si or Pd, by an ion plating technology, for example, in order to provide a desired characteristic X-ray emission. If an ion plating is applied to the target members separated each other, strong adhesion is established between the ion-plated characteristic X-ray emissive layer and the annular tapered surface portion, since the annular tapered surface portion of each target member can be subjected to the bombardment of ions impinging substantially perpendicular to the surface portion. (c) The relatively simplified structure of each target member facilitates a high precision machining thereof, and the annular V-groove can have a sharp or rather converging apex as compared with the conventional engraved V-groove having an apex including therein a flat surface portion as mentioned above. The converging apex is provided because the actual cross section of the annular tapered surface exhibits a smooth curvature at the portion thereof corresponding to the apex. Such sharp or converging apex is advantageous for preventing the above-mentioned excessive heat load at the apex and, hence, eliminates the above mentioned breakage of a rotary anode assembly.

FIG. 10 shows cross-sections of a rotary anode assembly in accordance with the third embodiment of the present invention, taken at different phases P1 and P2 of the rotation around the axis Z. The rotary anode assembly 100 comprises a pair of target members 101 having a structure essentially the same as that shown in FIG. 8A and being combined together as shown in FIG. 8B. The rotary anode assembly further comprises a pair of supporting members 102A and 102B which are coaxially disposed with the target members 101. The supporting member 102A is provided with a driving shaft portion 102A1 for rotating the assembly around the axis Z. The supporting members 102A and 102B have respective protruding portions 102A2 and 102B2 which are disposed in the hollow portions of the corresponding target members 101, the hollow portions being described with reference to FIG. 8A. Each of the protruding portions 102A2 and 102B2 has a coaxial annular cutout portion at the periphery thereof so as to provide a space 103 between the inner side surface of the target member 101 and the corresponding supporting member 102A or 102B.

The supporting members 102A and 102B are further provided with respective first channels 104A1 and 104B1 and second channels 104A2 and 104B2. The first channels 104A1 and 104B1 connect the respective spaces 103 between the corresponding target members and supporting members to a conduit 105, which is connected to a not-shown inlet. The second channels 104A2 and 104B2 connect the respective spaces 103 between the corresponding target members and supporting members to another conduit 106, which is connected to a not-shown outlet. The conduits 105 and 106 are formed in the supporting member 102A so as to extend to the driving shaft portion 102A1, in parallel to the axis Z. Third channels 105-1 and 106-1 are respectively formed through the target members 101 and the supporting member 102B so as to connect the channels 104B1 to the conduits 105, and 104B2 to the conduit 106.

The target members 101 and the supporting members 102A and 102B are united together by using securing means 107 such as screws and securing means 108 such as bolts, wherein sealing means such as O-rings 109-1, 109-2 and 109-3 are provided therebetween. Each of the O-rings is composed of an elastomer and has an appropriate size. Thus, fluid coolant such as water can be circulated between the not-shown inlet and outlet, flowing from the conduit 105 through the channels to the conduit 106, as indicated by arrows in FIG. 10. Accordingly, the colling efficiency at the V-grooved target portion is enhanced by the coolant. In the above rotary anode assembly 100, each of the protruding portions 102A2 and 102B2 may be formed separate from the corresponding supporting members 102A and 102B. And, the target members 101 and supporting members 102A and 102B may be joined together by welding applied between the respective contacting surfaces of the members, at least the surface portions to which the O-ring sealing are applied.

Figure 11A:
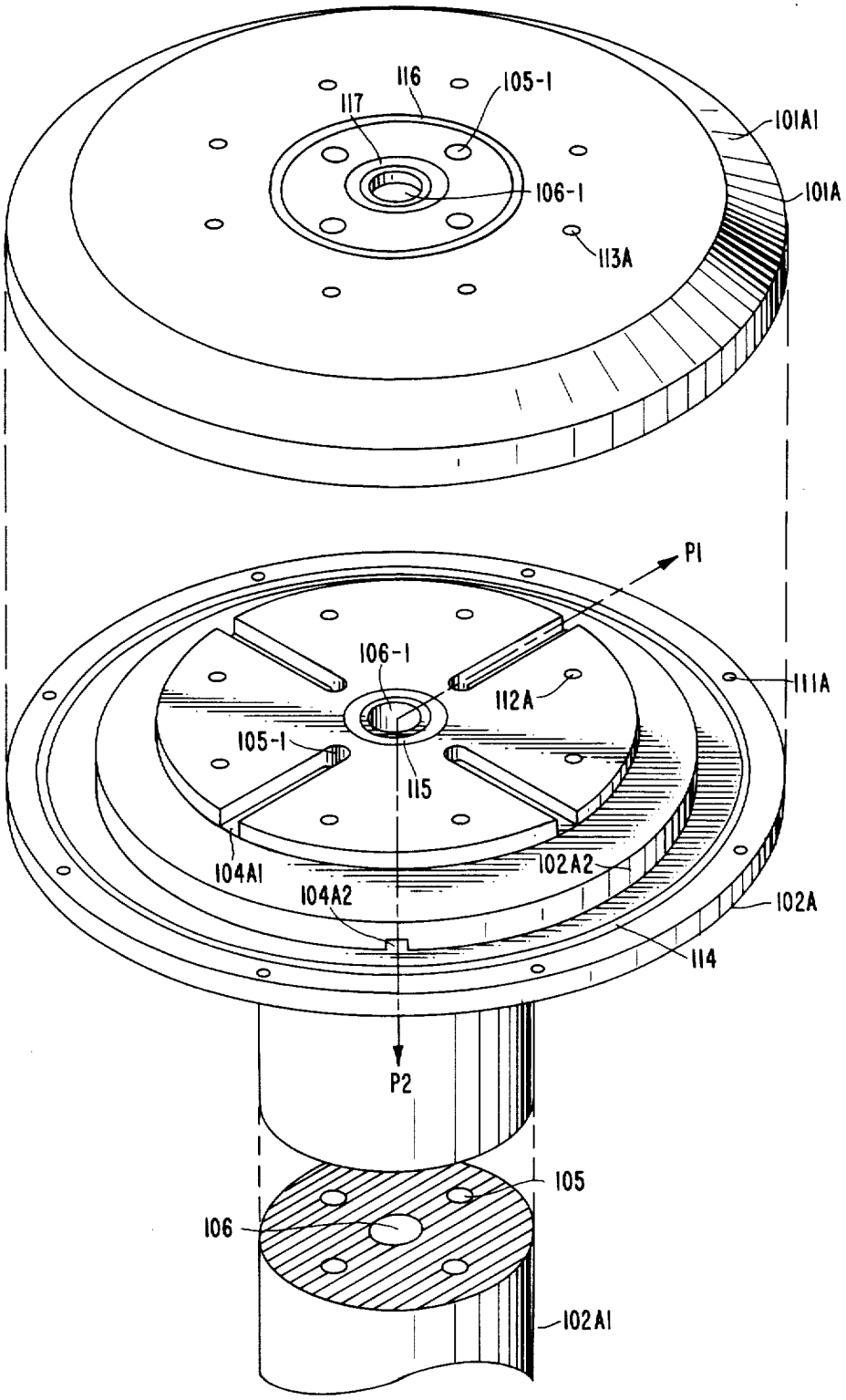
FIGS. 11A and 11B illustrate, in a set, a perspective view of the rotary anode assembly shown in FIG. 10.
Figure 11B:
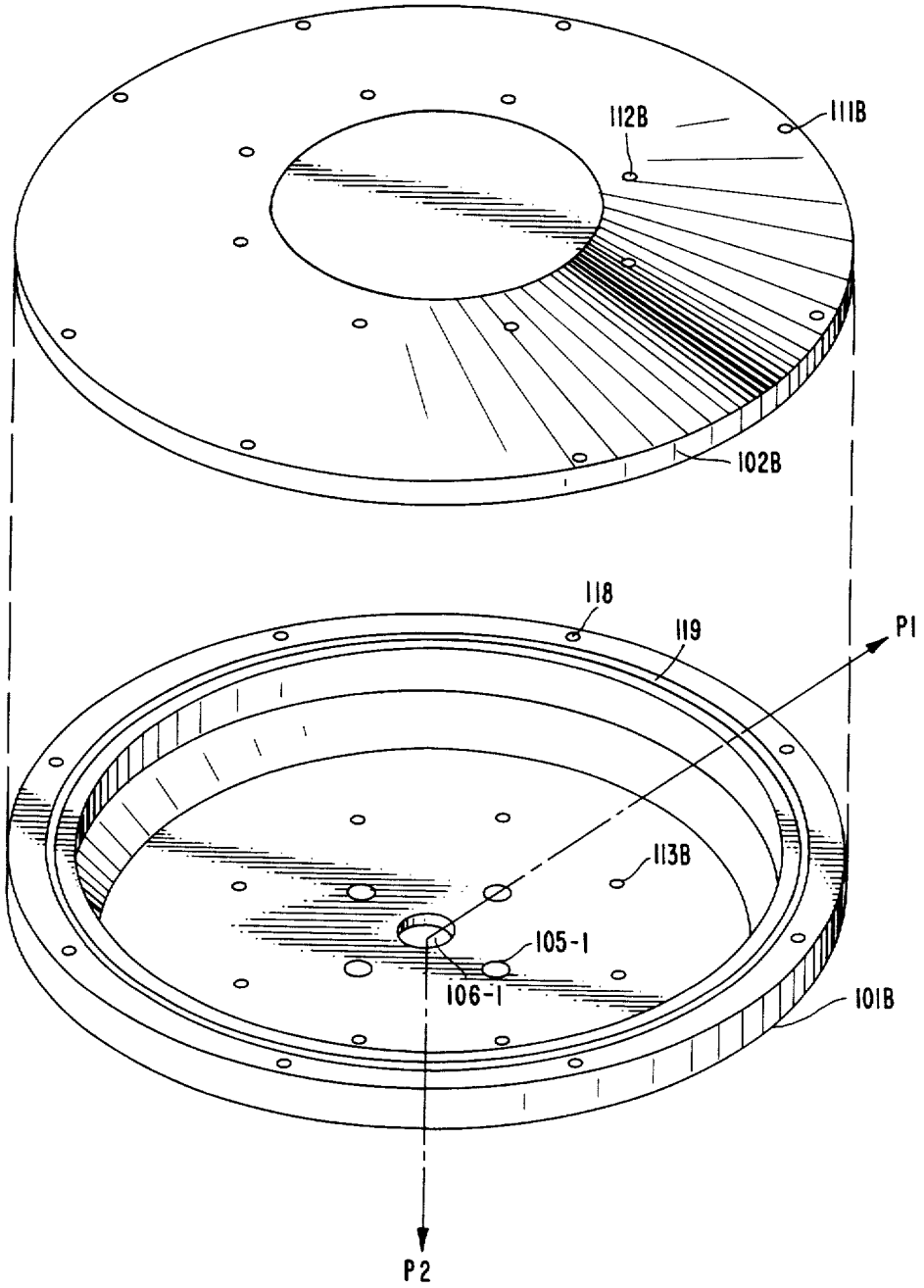

FIGS. 11A and 11B illustrate, in a set, an exploded perspective view of the rotary anode assembly shown in FIG. 10, wherein like reference numerals designate like or corresponding parts. In FIGS. 11A and 11B, P1 and P2 respectively designate the directions corresponding to the different phase cross-sections illustrated in FIG. 10. Further, the combined target members 101 in FIG. 10 are shown as the separate component target members 101A and 101B, respectively corresponding to the supporting members 102A in FIG. 11A and 102B in FIG. 11B. Referring to FIG. 11A, the target member 101A has a convex surface including therein an annular tapered surface portion 101A1. In the supporting member 102A, respective pluralities of bores 111A and 112A are formed corresponding to the screws 107 and bolts 108 shown in FIG. 10, while a plurality of bores 113A are formed in the target member 101A, corresponding to the bores 112A of the supporting member 102A. Reference numerals 114 and 115 designate grooves formed in the supporting member 102A, respectively corresponding to the O-rings 109-1 and 109-3, both being placed between the target member 101A and the supporting member 102A (see FIG. 10.) Reference numerals 116 and 117 designate grooves formed in the target member 101A, respectively corresponding to the O-rings 109-2 and 109-3, both being placed between the target members 101A and 101B (see FIG. 10.)

Referring to FIG. 11B, the target member 101B having the same structure as that of the target member 101A of FIG. 11A is illustrated upside down, showing a hollow portion formed in the side surface thereof opposite to the convex surface, as mentioned with reference to FIGS. 8A. As shown in the target member 101B, there are provided a plurality of tapped holes 118 and a groove 119 in the annular end surface of each target member, respectively corresponding to the screws 107 and the O-ring 109-1 shown in FIG. 10. As shown in FIG. 11B, the third channels 105-1 and 106-1 are formed to extend to the hollow portion of the target member 101B. The supporting member 102B shown upside down has the same structure as that of the supporting member 102A of FIG. 11A, except no driving shaft portion 102A as shown in FIGS. 10 and 11A. Inserting its protruding portion (see 102A2 in FIG. 11A, for example) into the hollow portion of the corresponding target member, each of the supporting members 102A and 102B is secured to the corresponding target members 101A and 101B by applying screws (see 107 in FIG. 10) through the bores 111A in FIG. 11A and 111B in FIG. 11B, formed at the peripheries of the supporting members, wherein the O-rings 109-1 and 109-3 are provided therebetween as shown in FIG. 10. The combined target member 101A and supporting member 102A and the other combined target member 101B and supporting member 102B are secured together by means of bolts (see 108 in FIG. 10) applied to the respective corresponding bores 112A, 112B, 113A and 113B, wherein the O-rings 109-2 and 109-3 are provided between the convex surfaces of the target members, as shown in FIG. 10.

FIG. 12 is a plan view of the supporting member 102A or 102B shown in FIGS. 11A and 11B, taken from the side contacting with the corresponding target member 101A or 101B, wherein like reference numerals designate corresponding parts. As shown in FIG. 12, each of the channels 104A1 (or 104B1) is a groove respectively formed in the open surface of the supporting member 102A or 102B, and connected to the corresponding one of perpendicularly extending third channels 105-1. Each of the channels 104A2 (or 104B2) is a tunnel respectively formed in the body of the corresponding supporting member 102A or 102B so as to connect the peripheral side of the protruding portions 102A2 or 102B2 of the corresponding supporting members to the perpendicularly extending third channel 106-1.

Figure 13:
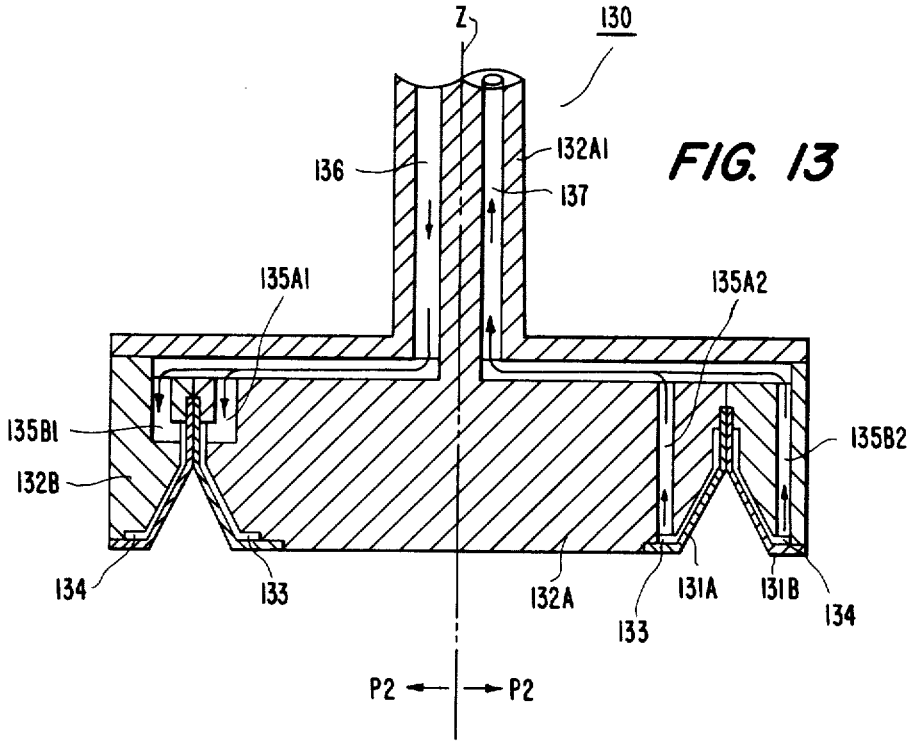
FIG. 13 shows cross-sections of a rotary anode assembly in accordance with the fourth embodiment of the present invention, taken at different phases of rotation.

FIG. 13 shows cross-sections of a rotary anode assembly in accordance with the fourth embodiment of the present invention, taken at different phases P1 and P2 of the rotation around the axis Z. The rotary anode assembly 130 comprises a first (inner) target member 131A and a second (outer) target member 131B, respectively having structures essentially the same as those described with reference to FIG. 9A and being combined together as shown in FIG. 9B. The rotary anode assembly includes a first (inner) supporting members 132A and a second (outer) supporting member 132B. The supporting member 132A is provided with a driving shaft portion 132A1 for rotating the anode assembly 130 around the axis Z. The inner supporting member 132A is coaxially disposed in the hollow portion of the first target member 131A. The supporting member 132B is an annular body with respect to the axis Z, receiving the supporting member 132A to be fixedly engaged therein. Further, the annular outer supporting member 132B is coaxially disposed to receive the annular cutout portion (see cutout portion 94A in FIG. 9B) of the second target member 131B, which is engaged therein.

The inner supporting member 132A is provided with a first annular cutout portion 133 formed at the peripheral edge portion thereof, corresponding to the annular tapered surface portion of the inner target member 131A. The annular outer supporting member 132B is provided with a second annular cutout portion 134 formed at the inner peripheral edge portion thereof, corresponding to the annular tapered surface portion of the outer target member 131B. Thus, each of the first and second annular cutout portions 133 and 134 respectively provides a space between the supporting member 132A and the corresponding target member 131A, and the supporting member 132B and the corresponding target member 131B.

The inner supporting member 132A is provided with first channels 135Al and second channels 135A2 and the outer supporting member 132B is provided with first channels 135B1 and second channels 135B2. These channels are connected to either of the spaces 133 or 134. Each of the first channels 135Al and 135B1 is connected to a conduit 136 which is linked to a not-shown inlet, while each of the second channels 135A2 and 135B2 is connected to a conduit 137 which is linked to a not-shown outlet.

The target members 131A and 131B and the supporting members 132A and 132B are joined together by using suitable securing means and sealing means such as screws and O-rings as employed in the third embodiment of FIG. 10. Thus, a kind of fluid coolant such as water can be circulated between the inlet and outlet, flowing from the conduit 135 through the channels to the conduit 136, as indicated by arrows in FIG. 13. Accordingly, the cooling efficiency at the V-grooved target portion formed from the tapered surfaces of the target members 131A and 131B is enhanced by the coolant. In the above rotary anode assembly 130, the target members 131A and 131B and the supporting members 132A and 132B may be joined together by welding applied between the respective contacting surfaces, at least the surface portions to which O-ring sealing is applied.

Figure 14:
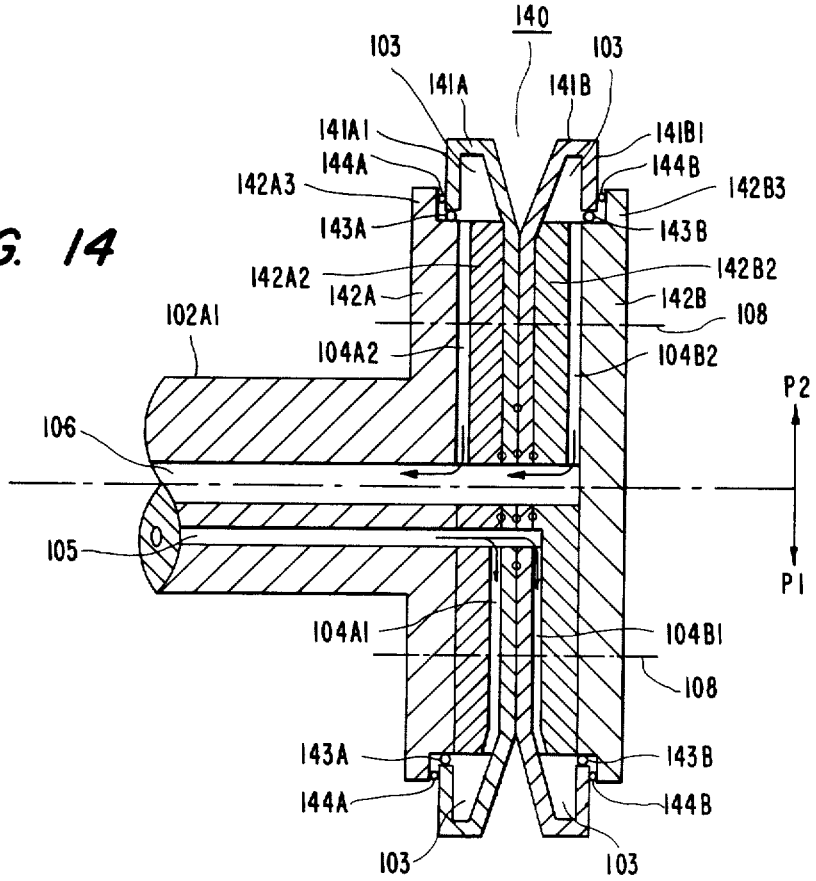
FIG. 14 shows cross-sections of a rotary anode assembly in accordance with the fifth embodiment of the present invention, taken at different phases of rotation.

FIG. 14 shows a cross-section of a rotary anode assembly in accordance with the fifth embodiment of the present invention, taken at different phases P1 and P2 of the rotation around the axis Z. In FIG. 14, like reference numerals designate like or corresponding parts in FIG. 10, except for the featured portions provided according to this embodiment. The rotary anode assembly 140 comprises target members 141A and 141B and supporting members 142A and 142B, respectively having structures essentially the same as the equivalents in the anode assembly 100 of FIG. 10. That is, each of the target members 141A and 141B has a convex surface and a hollow portion. The supporting member 142A is provided with a driving shaft 102A1 and channels 104A1 and 104A2, both connected to the space 103 between the target member 141A and the supporting member 142A. The supporting member 142B is provided with channels 104B1 and 104B2, both connected to the space between the target member 141B and the supporting member 142B. The channels 104A1 and 104B1 are connected to the conduits 105, while the channels 104A2 and 104B2 are connected to the conduit 106, both conduits 105 and 106 being formed in the driving shaft 102A1. The target members 141A and 141B and supporting members 142A and 142B are coaxially disposed with respect to the axis Z and united together with securing means 108 such as bolts. Thus, fluid coolant can be circulated to cool the V-groove formed from the target members 141A and 141B, flowing from the conduit 105 through the spaces 103 to the conduit 106 along the arrows as shown in FIG. 14. Also in this embodiment, the respective protruding portions 142A2 and 142B2 of the supporting members 142A and 142B, disposed in the hollow portions of the corresponding target members 141A and 141B, may be formed as separate members from the respective main bodies 142A and 142B.

Each of the target members 141A and 141B is further provided with a coaxially-disposed annular plate member 141A1 and 141B1, respectively. Each of the annular plate members 141A1 and 141B1 has an outer perimeter and an inner perimeter. The outer perimeter is joined to the periphery of the corresponding target member 141A or 141B. The inner perimeter radially receives the peripheral side surface of the corresponding supporting member 142A or 142B disposed so as to engage therein, wherein suitable sealing means such as O-rings 143A and 143B of an elastomer are respectively provided between the inner perimeters of the annular plate members 141A1 and 141B1 and the peripheral side surfaces of the corresponding supporting members 142A and 142B. Thus, the target members 141A and 141B respectively associated with the plate members 141A1 and 141B1 constitute an M-shaped cross-section at the periphery of the anode assembly 140, as shown in FIG. 14.

In the rotary anode assembly, the force applied perpendicularly to the respective inside surfaces of the supporting members 142A and 142B due to the pressure of the fluid coolant can be significantly decreased. That is, when a rotary anode assembly rotates at high speed, the pressure of the fluid coolant increases in the anode assembly. due to the centrifugal force. The pressure exhibits a force acting to separate the supporting members 142A and 142B from each other. It should be noted that the increment in the pressure is proportional to the square of the radius of rotation and that the internal surface areas of the channel portions 104A1, 104A2, 104B1 and 104B2, even in total, are small compared with the internal surface area of the space 103 between the target member 141A or 141B and the corresponding supporting member 142A or 142B. Therefore, it can be assumed that most of the force acting to separate the target members is generated at the space 103. An exemplary figure for the force generated by water coolant flowing through the rotary anode assembly 140 rotating at 10,000 rpm is estimated as approximately 4,300 Kg, by assuming the respective radiuses of the outer and inner radii of the above-mentioned annular plate member 141A1 or 141B1 are 10 cm and 8.5 cm, respectively, and the static pressure of the water coolant is 1 atm. In the rotary anode assembly as shown in FIG. 10, the securing means 108 such as bolts must withstand the force. From the view point of the tensile strength of a material such as stainless steel for the bolts, a number of bolts 108 each having a reasonable diameter are needed. This inevitably imposes difficulties on the anode assembly design as well as the increase in the weight thereof.

However, in the rotary anode assembly as shown in FIG. 14, the annular plate members 141A1 and 141B1 by themselves withstand against the internal pressure increased due to the centrifugal force during the high speed rotation of the anode assembly, while only the force generated by the pressure applied to the channel portions 104A1, 104A2, 104B1 and 104B2 is burdened on the securing means 108. As a result, the above-mentioned problems of the increase in the number of the bolts 108 and difficulties in the design of the FIG. 10 rotary anode assembly can greatly be alleviated. A further reduction in the weight of the rotary anode assembly can be achieved, because the screws 107 and O-ring 109-1 in the FIG. 10 anode assembly become unnecessary in this embodiment and the supporting members 142A and 142B can be small by the peripheral portions thereof provided for this purpose.

Figure 1:
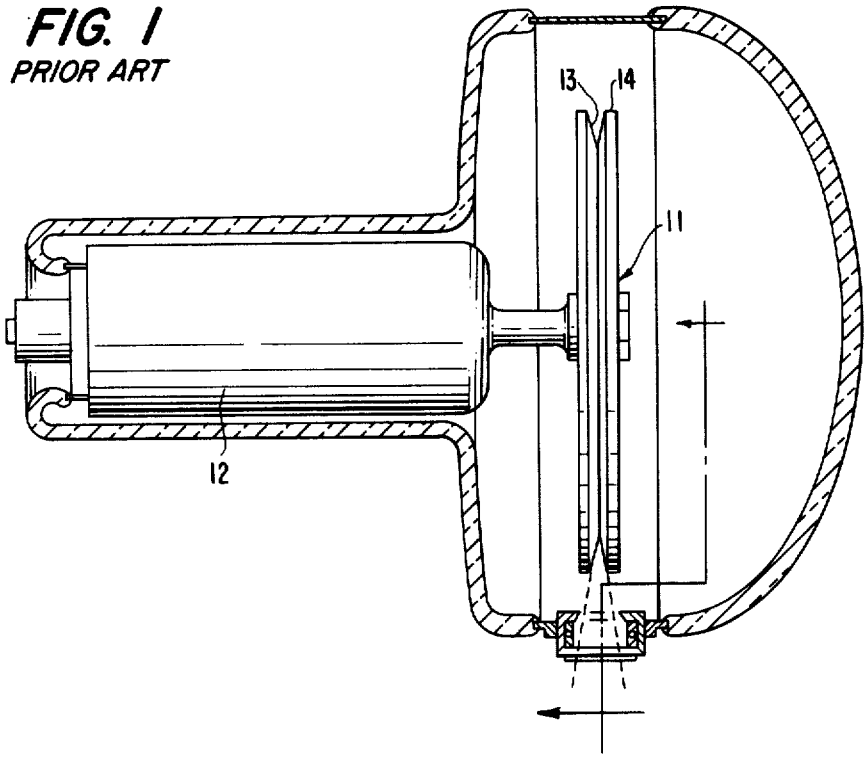
FIG. 1 PRIOR ART
FIGS. 1 to 6 respectively show different prior art rotating anodes each having a V-groove as a target portion of an electron beam bombardment type X-ray source.
Figure 15:
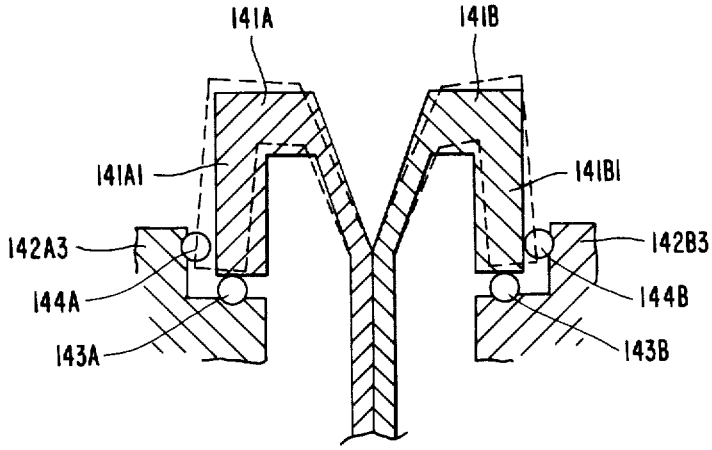
FIG. 15 is a partial cross-section showing the deformation of the target member embodied in FIG. 14.
Figure 2:
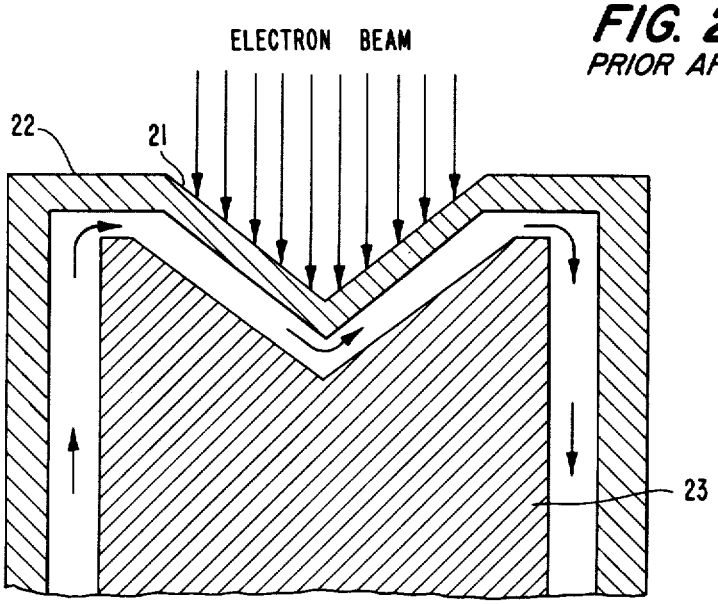
FIG. 2 PRIOR ART
Figure 3:
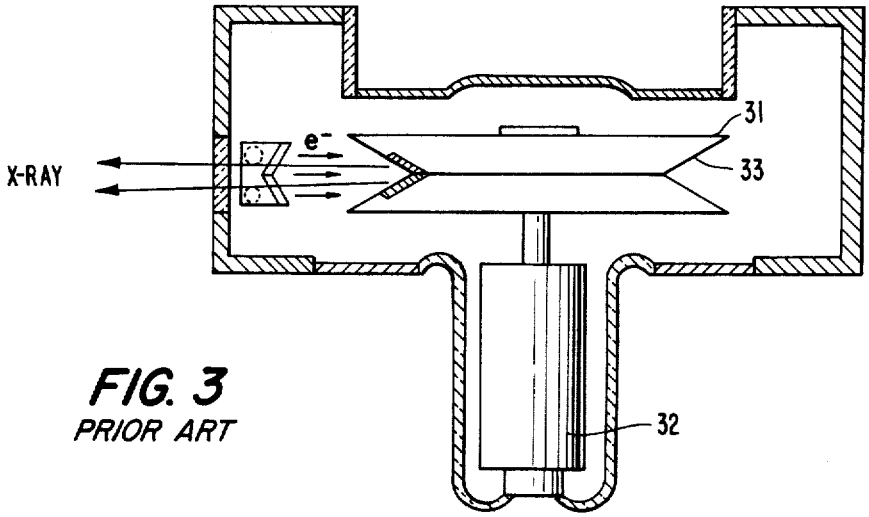
FIG. 3 PRIOR ART
Figure 4:
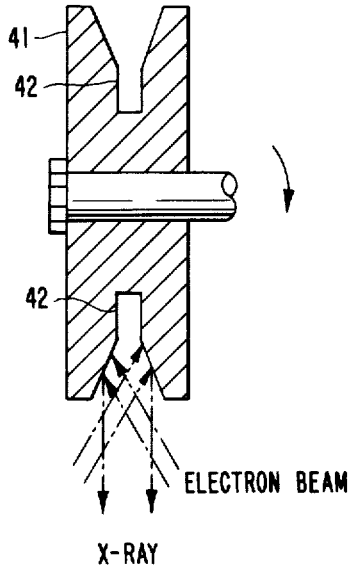
FIG. 4 PRIOR ART
Figure 5:
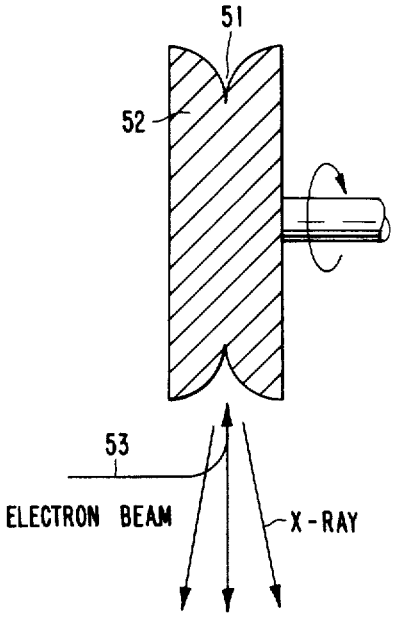
FIG. 5 PRIOR ART
Figure 6:
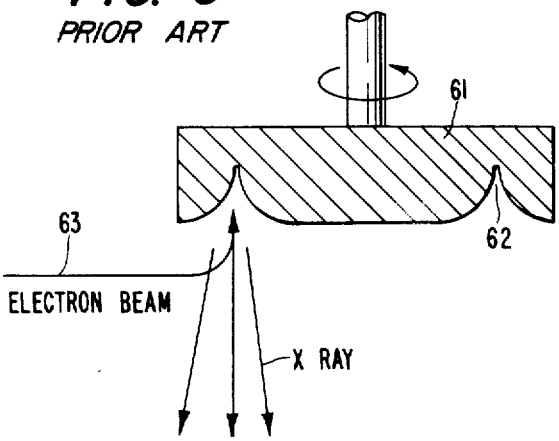
FIG. 6 PRIOR ART

Being not indispensable, rim portions 142A3 and 142B3 are respectively provided for the supporting members 142A and 142B. There are further provided a sealing means 144A between the annular plate member 141A and the rim portion 142A3 and another sealing means 144B between the annular plate member 141B and the rim portion 142B3. These sealing means 144A and 144B, each being an O-ring of an elastomer, for example, enhance the sealing between the target members and the supporting members. That is, the annular plate members 141A1 and 141B1 are slightly deformed outside in the direction parallel to the axis Z, as shown by the dotted line in FIG. 15, when the internal pressure is increased during the high speed rotation of the rotary anode assembly 140. As a result, the sealing is increasingly tightened. In this case, the stresses caused by the deformations of the annular plate members 141A1 and 141B1 are absorbed by the respective elastic O-rings 144A and 144B, and there is no substantial increase in the force applied to rim portions 142A3 and 142B3.

Figure 16A:
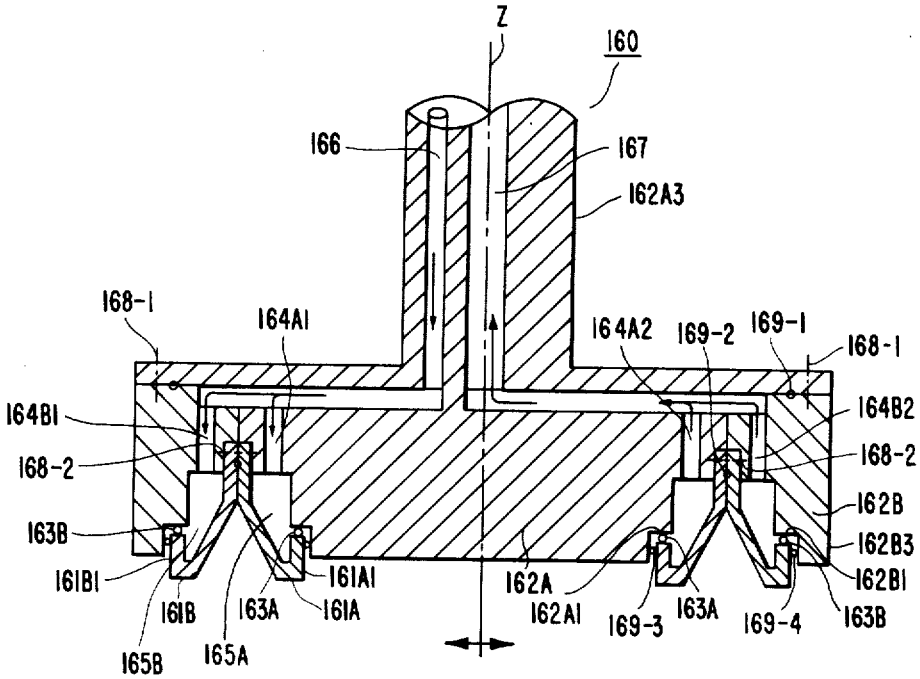
FIG. 16A is cross-sections of a rotary anode assembly in accordance with the sixth embodiment of the present invention, taken at different phases of rotation.
Figure 16B:
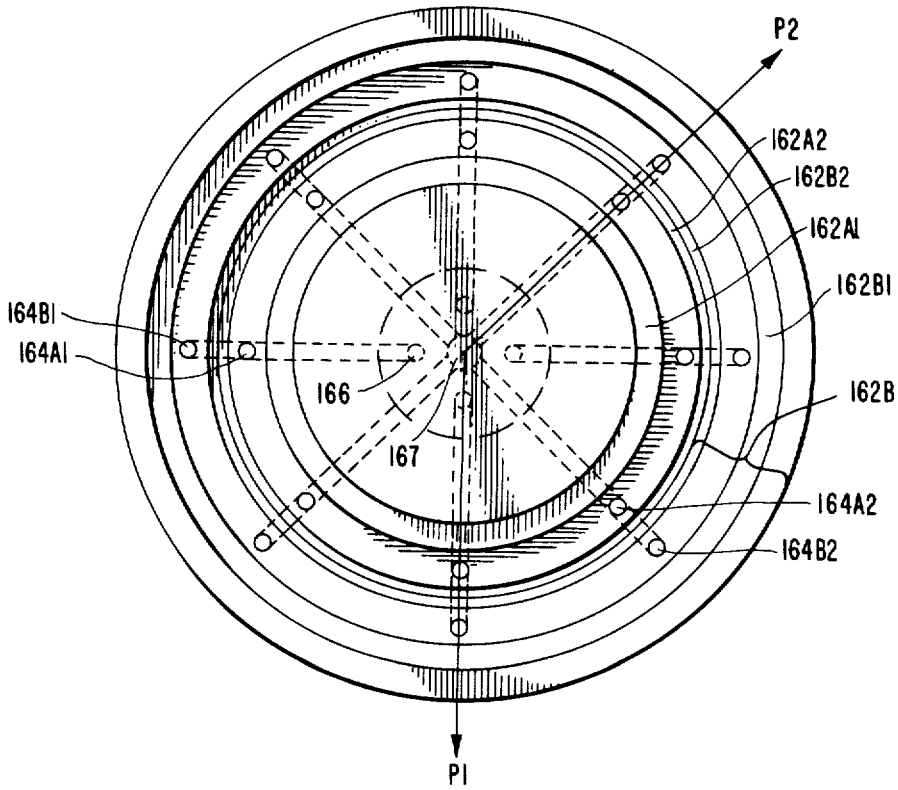
FIG. 16B is a plan view of the supporting members incorporated in the anode assembly of FIG. 16A.

FIG. 16A is a cross-section of a rotary anode assembly in accordance with the sixth embodiment of the present invention, taken at different phases P1 and P2 of the rotation around the axis Z, and FIG. 16B is a plan view of supporting members incorporated therein. In this embodiment rotary anode assembly 160, an annular V-groove target portion is formed in the side plane of the assembly, like in the fourth embodiment rotary anode assembly shown by FIG. 13. The target members forming the annular V-groove have an M-shaped cross-section like in the fifth embodiment rotary anode assembly shown by FIG. 14. Referring to FIG. 16A, the rotary anode assembly 160 comprises a first (inner) target member 161A, an annular second (outer) target member 161B, a first (inner) supporting member 162A and an annular second (outer) supporting member 162B. The target members 161A and 161B and supporting members 162A and 162B are united together by using suitable securing means.

Referring to FIG. 16A, the inner target member 161A is provided with a coaxially-disposed first cylindrical member 161A1. The first cylindrical member 161A1 is joined with the inner target member 161A through its one longitudinal end and extends at its another end to the hollow portion of the inner target member 161A. The annular outer target member 161B is provided with a coaxially-disposed second cylindrical member 161B1. The second cylindrical member 161B1 is joined with the outer target member 161B through its one longitudinal end and extends at its another end to the cutout portion (see FIG. 9B) of the outer target member 161B. The another longitudinal ends of the first and second cylindrical members 161A1 and 161B1 are respectively received by the corresponding planer side surfaces (steps) 162A1 and 162B1 of the inner and outer supporting members 162A and 162B, wherein respective sealing means 163A and 163B, each an O-ring of an elastomer, for example, are provided therebetween.

The inner supporting member 162A is provided with a driving shaft portion 162A3 for rotating the anode assembly 160 around the axis Z, and first and second channels 164A1 and 164A2. The outer supporting member 162B is provided with first and second channels 164B1 and 164B2. The first channels 164A1 and 164B1 respectively connect the spaces 165A and 165B to a conduit 166, while the second channels 164A2 and 164B2 respectively connect the spaces 165A and 165B to another conduit 167. Both conduits 166 and 167 are formed in the driving shaft portion 162A3. Thus, fluid coolant such as water can be circulated from the conduit 166 through the spaces 165A and 165B to the conduit 167 as indicated by arrows, thereby enhancing the heat dissipation at the V-groove target portion of the rotary anode assembly 160.

The target members 161A and 161B and supporting members 162A and 162B are combined together by securing means 168-1, screws, for example. The target members 161A and 161B are partially engaged in an annular rectangular groove formed from the respective cutout portions 162A2 and 162B2 of the supporting members 162A and 162B, and are secured thereto by securing means 168-2, screws, for example, as shown in FIG. 16B. Sealing means such as an elastomer O-ring 169-1 is provided for sealing the contacting surfaces between the first and second supporting members 162A and 162B. Sealing means 169-2 such as an elastomer O-ring is provided for sealing the contacting surface between the inner and outer target members 161A and 161B. Sealing means 169-3 such as an elastomer O-ring is provided between the first cylindrical member 161A1 and the peripheral side surface of the inner supporting member 162A and sealing means 169-4 such as an elastomer O-ring is provided between the second cylindrical member 161B1 and an annular rim portion 162B3 of the outer supporting member 162B. These sealing means 169-3 and 169-4 are not indispensable, but advantageous for enhancing the sealing between the target members and the supporting members, as described in the fifth embodiment shown in FIG. 14.

We claim:

1. A rotary anode assembly for an X-ray source, the rotary anode assembly rotating around an axis of rotation and having a V-groove constituting a target portion therefor, the V-groove being annular with respect to the axis of rotation, comprising:

a pair of target members each being a body of rotation with respect to the axis, each of said target members having a coaxially-formed annular tapered surface portion formed at the periphery thereof, and said target members being fabricated separate each other and then coaxially disposed in a manner that respective said annular tapered surface portions thereof face to each other with a predetermined angle therebetween so as to constitute the annular V-groove of said rotary anode assembly.

2. An anode assembly as set forth in claim 1, wherein each of said target members has a coaxially-formed convex surface including therein said annular tapered surface portion, and said target members are disposed in a manner that said convex surfaces contact with each other, except for respective said annular tapered surface portions thereof, such that said rotary anode assembly is provided with a peripheral surface having the annular V-groove formed therein.

3. An anode assembly as set forth in claim 2, wherein each of said target members has a coaxially-formed concaved surface providing a hollow in the side surface thereof opposite to said convex surface, said anode assembly further comprising:

a pair of supporting members for said target members, each of said supporting members having a substantially disc structure rotating around the axis of rotation and being engaged in said hollows of corresponding said target member, thus, said supporting members being combined with said target members in a coaxial relationship, each of said supporting members being provided with;

an annular cutout portion formed at the periphery thereof, corresponding to said concave surface portion opposite to said annular tapered surface portion of corresponding said target member, thus, said annular cutout portion providing a space between corresponding said target member and said supporting member; and first and second channels formed therein, each of said first and second channels being connected to said space, said first channel having an opening connected to an inlet and said second channel having an opening connected to an outlet, wherein third channels for connecting respective corresponding first and second channels of said supporting members each other are provided in each of said target members, such that a fluid coolant for cooling said annular tapered surface portions of said target members can be supplied to said space by circulating the coolant between the inlet and outlet through said first and second channels.

4. An anode assembly as set forth in claim 3, wherein each of said supporting members has a cylindrical side surface portion formed coaxial with respect to the axis of rotation, and each of said target members is provided with a coaxially-disposed annular plate member having an outer perimeter and an inner perimeter, said outer perimeter being joined to the periphery of corresponding said target member and said inner perimeter radially receiving said cylindrical side surface of corresponding said supporting member with a sealing means provided therebetween.

5. An anode assembly as set forth in claim 1, wherein said tapered surface portion of each said target member is coated with an X-ray emissive material layer.

6. An anode assembly as set forth in claim 1, wherein said target member is formed from a copper-based alloy.

7. An anode assembly as set forth in claim 4, wherein said sealing means provided between said inner perimeter of said annular plate member of said target member and said cylindrical surface of said supporting member is an O-ring of an elastomer.

8. An anode assembly as set forth in claim 4, wherein said sealing means is provided by welding said inner perimeter of said annular plate member of said target member to said cylindrical surface of said supporting member.

9. An anode assembly as set forth in claim 1, wherein one of said target members is an inner body having a coaxially-formed outer side surface including therein said annular tapered surface portion, and the other of said target members is an annular outer body having a coaxially-formed inner side surface including therein said annular tapered surface portion, and said inner and annular outer target members are disposed in a manner that said coaxially-formed outer side surface of said inner target member is fixedly engaged in said annular outer target member, such that said rotary anode assembly is provided with a planer side surface in which the annular V-groove is formed, said planer side surface being disposed rectangular to the axis of rotation.

10. An anode assembly as set forth in claim 9, wherein said inner target member is provided with a hollow in a side thereof opposite to said planer side surface of said anode assembly, and said annular outer target member is provided with a coaxially-formed annular cutout portion formed in the annular outer side surface thereof, said anode assembly further comprising:

a pair of first and second supporting members for said target members, said first supporting member having a substantially disc structure rotating around the axis of rotation and being engaged in said hollow of said inner target member, said second supporting member being annular with respect to the axis of rotation and receiving said annular cutout portion of said annular outer target member engaged therein, said first and second supporting members being combined with said inner and outer target members in a coaxial relationship, wherein said first supporting member is provided with;

a first annular cutout portion formed at the peripheral edge portion thereof, corresponding to said annular tapered surface portion formed in said inner target member, and said second supporting member is provided with;

a second annular cutout portion formed at the inner peripheral edge portion thereof, corresponding to said annular tapered surface portion formed in said outer target member; thus, each of said first and second cutout portions respectively providing a space between corresponding said target member and said supporting member, and each of said first and second supporting members is provided with;

First and second channels formed therein, each of said first and second channels being connected to said space, said first channel having an opening connected to an inlet and said second channel having an opening connected to an outlet, such that a fluid coolant for cooling said annular tapered surface portions of said target members can be supplied to said space by circulating the coolant between the inlet and outlet through said first and second channels.

11. An anode assembly as set forth in claim 10, wherein each of said first and second supporting members has a flat side surface formed in parallel to and adjacent to said planer surface of said anode assembly, and said inner target member is provided with a first cylindrical member, said first cylindrical member being coaxially-disposed in said inner target member and having longitudinal ends, one of said longitudinal ends of said first cylindrical member being joined to said inner target member and the other of said longitudinal ends of said first cylindrical member extending toward said hollow of said inner target member, and said outer target member is provided with a second cylindrical member, said second cylindrical member being coaxially-disposed to encircle said outer target member and having longitudinal ends, one of said longitudinal ends of said second cylindrical member being joined to said outer target member and the other of said longitudinal end of said second cylindrical member extending toward said cutout portion of said outer target member, and wherein respective the other longitudinal ends of said first and second cylindrical members are respectively received by corresponding said planer side surfaces of said first and second supporting members, wherein respective sealing means are provided therebetween.

12. An anode assembly as set forth in claim 9, wherein said tapered surface portion of each said target member is applied with a coating of an X-ray emissive material layer.

13. An anode assembly as set forth in claim 9, wherein said target member is formed from a copper-based alloy.

14. An anode assembly as set forth in claim 11, wherein each of said sealing means provided between said the other longitudinal ends of said first and second cylindrical members and corresponding said planer surfaces of said first and second supporting members are composed of an elastomer.

15. An anode assembly as set forth in claim 11, wherein each of said sealing means is provided by welding said the other longitudinal end of each of said first and second cylindrical members to corresponding said planer surfaces of said first and second supporting member.

* * * * *

UNITED STATES PATENT AND TRADEMARK OFFICE

CERTIFICATE OF CORRECTION

ıTENT NO. : 4,719,645

ıTED : January 12, 1988

VENTOR(S) : Yamabe et al.

It is certified that error appears in the above-identified patent and that said Letters Patent is hereby rrected as shown below:

Col. 6, line 13, "separated" should be --separating--.

Col. 7, line 14, "colling" should be --cooling--;
line 56, "FIGS." should be --FIG.--.

Col. 8, line 42, "members" should be --member--.

Col. 11, lines 46 and 48, "another" should be --other--.

Col. 13, line 12, after "bers" insert --to--.

Col. 14, line 23, "First" should be --first--.

Col. 15, line 5, delete "the".

Signed and Sealed this

Fifth Day of July, 1988

*Attest:*

*Attesting Officer*

DONALD J. QUIGG

*Commissioner of Patents and Trademarks*